United States Patent [19]

Williams

[11] 4,452,481

[45] Jun. 5, 1984

[54] LIFTING TONGS

[76] Inventor: James N. Williams, 335 Cooper St., Woodbury, N.J. 08096

[21] Appl. No.: 339,108

[22] Filed: Jan. 13, 1982

[51] Int. Cl.[3] ..... B66C 1/00

[52] U.S. Cl. ..... 294/118; 294/90

[58] Field of Search ..... 294/88 R, 118, 106, 294/119, 90, 86 R, 101, 114, DIG. 1, DIG. 2, 115

[56] References Cited

U.S. PATENT DOCUMENTS

| | | | |
|---|---|---|---|
| 2,526,085 | 10/1950 | Rotollo | 294/118 |
| 3,572,808 | 3/1971 | Miller | 294/118 |
| 3,948,552 | 4/1976 | Hamrick | 294/118 |
| 4,109,953 | 8/1978 | Seymour | 294/118 |

FOREIGN PATENT DOCUMENTS

| | | | |
|---|---|---|---|
| 2260720 | 12/1972 | Fed. Rep. of Germany | 294/118 |

*Primary Examiner*—James B. Marbert

*Attorney, Agent, or Firm*—Duffield & Lehrer

[57] ABSTRACT

Lifting tongs for a crane include a pair of tong arms pivoted together adjacent their centers. A tension spring biases the tongs into a closed position and a hydraulic cylinder moves the tongs opened and closed. A substantially V-shaped jaw is mounted on the lower end of each tong arm and is pivotally adjustable to accommodate various size workpieces. An alternative pair of jaws for lifting cylindrical members such as logs is also provided.

6 Claims, 6 Drawing Figures

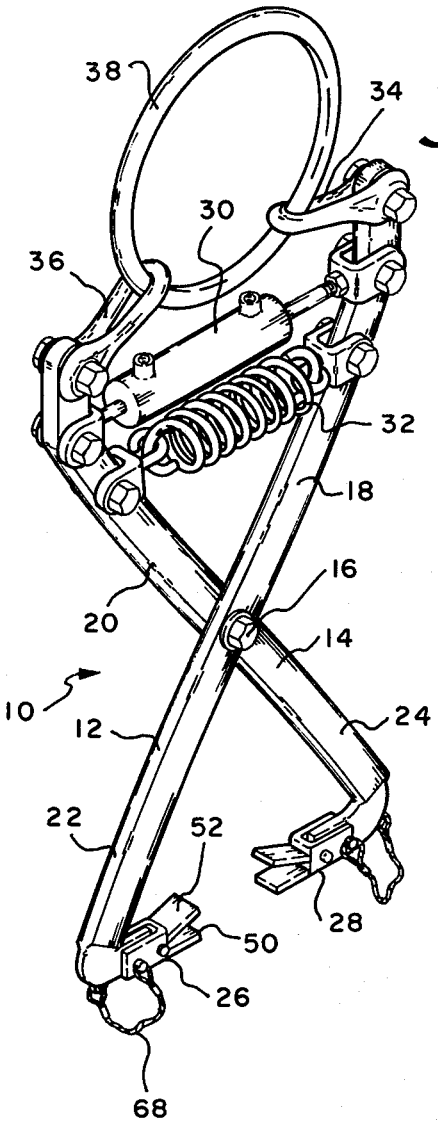
Fig. 1
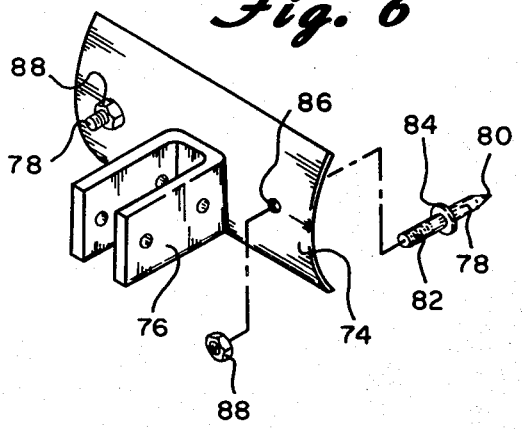
Fig. 6
Fig. 2
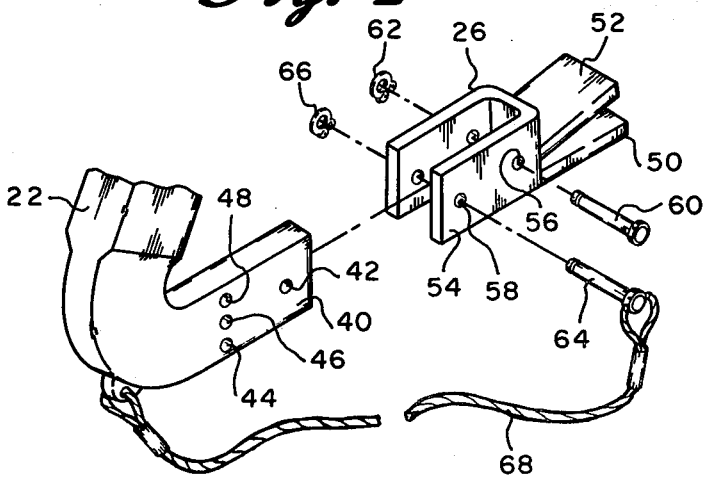

LIFTING TONGS

BACKGROUND OF THE INVENTION

The present invention is directed toward lifting tongs for use with a crane and more particularly toward such lifting tongs which have adjustable and interchangeable jaws so that the same can be used to lift various different materials of different sizes.

Various lifting tongs for lifting I-beams and the like have been proposed in the past. These are shown, for example, in U.S. Pat. Nos. 3,201,167 and 3,572,808. In each of these patents, the claws include jaws which fit around the edges of the top flange of the I-beam. These would appear to function properly for a particular size I-beam. However, for different size I-beams having different widths or thicknesses of the upper flange, the known tongs will not grip properly which can create a seriously dangerous situation.

The prior art also suffers from another serious defect. Insofar as Applicant is aware, all prior art lifting tongs are specifically designed for a particular application. There are no devices known to applicant which are adaptable to numerous different applications for lifting various different types of materials. This, of course, significantly increases capital costs since a contractor, builder or similar business would have to own numerous different lifting tongs.

SUMMARY OF THE INVENTION

The present invention overcomes the deficiencies of the prior art described above and provides lifting tongs which are capable of properly gripping numerous different types of materials of various sizes. In accordance with the invention, lifting tongs for a crane include a pair of tong arms pivoted together adjacent their centers. A tension spring biases the tongs into a closed position and a hydraulic cylinder moves the tongs opened and closed. A substantially V-shaped jaw is mounted on the lower end of each tong arm and is pivotally adjustable to accommodate various size workpieces. An alternative pair of jaws for lifting cylindrical members such as logs is also provided.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

FIG. 1 is a perspective view of lifting tongs constructed in accordance with the principles of the present invention;

FIG. 2 is a detailed view showing the manner in which the jaws are attached to the tong arms;

FIG. 6 illustrates an alternative form of jaw for use with the present invention.

DETAILED DESCRIPTION OF THE PREFERRED EMBODIMENT

Figure 3:
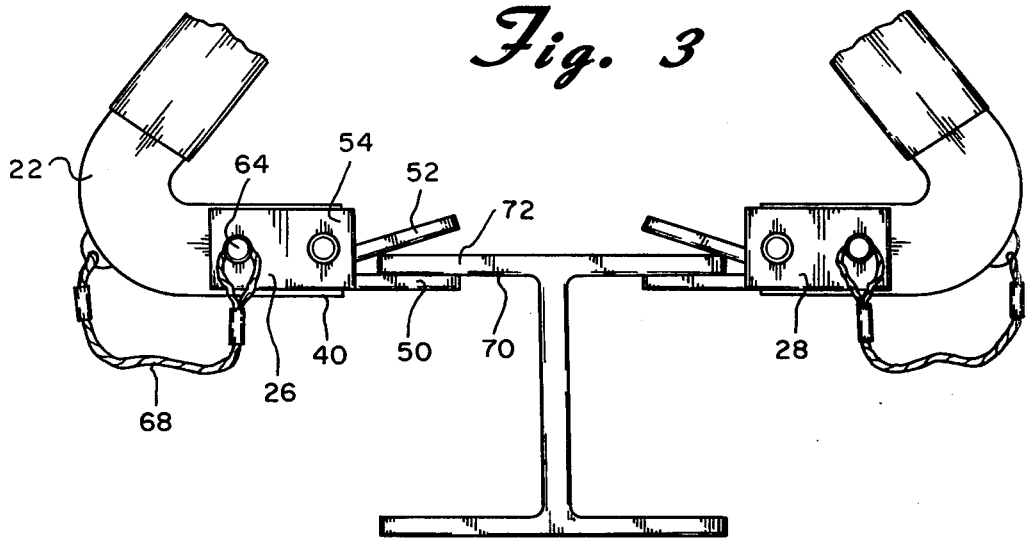
FIG. 3 illustrates the jaws in an intermediate position.

Referring now to the drawings in detail wherein like reference numerals have been used throughout the various figures to designate like elements, there is shown in FIG. 1 a perspective view of lifting tongs constructed in accordance with the principles of the present invention and designated generally as 10. The tongs are comprised essentially of a pair of tong arms 12 and 14 which are pivoted together at approximately their midpoints by a pivot pin 16 thereby forming upper tong arm portions 18 and 20 and lower tong arm portions 22 and 24.

As will be explained in more detail hereinafter, jaws 26 and 28 are mounted on the ends of the lower tong arm portions 22 and 24, respectively. The lower tong arm portions and the jaws can be moved toward and away from each other by the use of a hydraulic cylinder 30 connected between the upper tong arm portions 18 and 20. This is, of course, by way of example only as other types of motive means such as an electric solenoid or the like could also be used. A tension spring 32 also connected between the upper tong arm portions 18 and 22 biases the lower tong arm portions 22 and 24 and the jaws 26 and 28 into a closed position, i.e. toward each other.

Pivotally connected to the extreme upper ends of the upper tong arm portions 18 and 20 are guide loops 34 and 36, respectively. Passing through the guide loops 34 and 36 is a ring 38. A hook or similar device from a lifting crane is adapted to be connected to the hoop 38 for the purpose of moving the tongs 10 and the material being carried thereby. It should be readily apparent that the ring 38 and loops 34 and 36 cooperate to provide an inward force on the upper tong portions 18 and 20 and thus the lower tong arm portions 22 and 24 whenever a vertical force such as from a crane is applied to the ring 38.

The details of the jaws 26 and 28 and the manner in which they connect to the lower tong arm portions are shown most clearly in FIG. 2. Only jaw member 26 and lower tong arm portion 22 are illustrated in detail in this figure. It should be understood, however, that the following explanation applies equally to the other jaw 28 and lower tong arm portion 24.

Referring now to FIG. 2, it can be seen that the extreme end 40 of lower tong arm portion 22 is bent inwardly to a substantially horizontal position. A first hole 42 adjacent the end passes through the horizontal portion 40 substantially centrally thereof. Located slightly inwardly from the hole 42 are a series of substantially vertically aligned holes 44, 46 and 48.

The jaw 26 includes a lower jaw member 50 which lies in a substantially horizontal plane. An upper jaw member 52 lies above member 50 and extends at an angle with respect to the same. Both jaw members 50 and 52 are secured to the top wall of a substantially U-shaped coupling member 54. Coupling member 54 includes holes 56 and 58 therein which are adapted to cooperate with the various holes in the end 40 of the lower tong arm portion 22. More particularly, the U-shaped member 54 fits over the end portion 40 with hole 56 in alignment with hole 42 and hole 58 in alignment with either one of holes 44, 46 or 48. With the jaw 26 in place, pivot pin 60 is inserted through holes 56 and 42 and is retained therein parallel to pin 16 by way of a spring clip 62 or similar device. For the reasons which will become clearer hereinafter, hole 58 is capable of aligning with either of the holes 44, 46 or 48 and is retained in the desired position by pin 64 and spring clip 66. In order to prevent the accidental loss of the pin 64, the same is preferably carried by a short piece of wire rope or chain 68 which has its other end secured to the lower tong arm portion 22.

Figure 4:
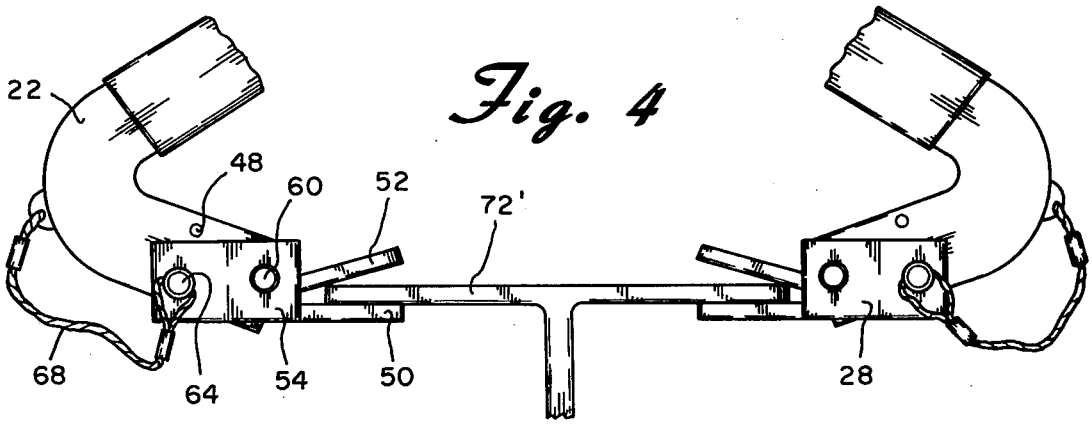
FIG. 4 illustrates the jaws arranged in a position for lifting larger I-beams.
Figure 5:
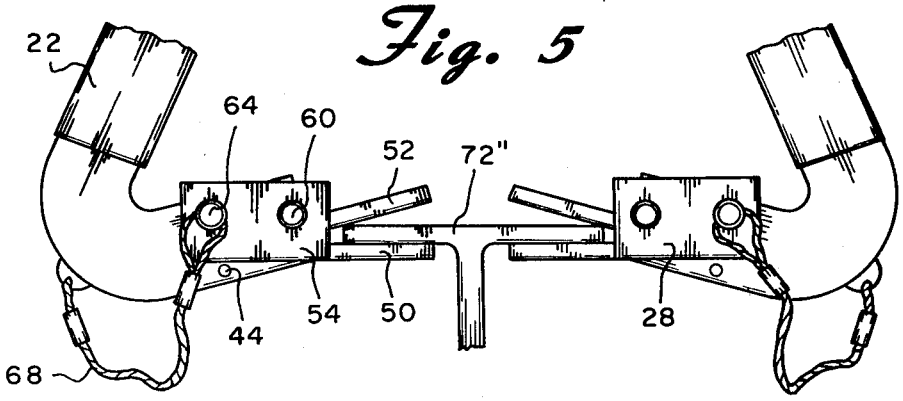
FIG. 5 shows the jaws in position for lifting smaller I-beams.

FIGS. 3, 4 and 5 illustrate the manner in which the jaws 26 and 28 of the present invention allow the tongs to be used with various size I-beams. When lifting an I-beam, it is preferable to have the lower jaw member 50 substantially flush with the undersurface 70 of flange 72 of the I-beam. The flange is held in place in the V-shaped opening between the lower and upper jaw members 50 and 52. In FIG. 3, the hole 58 in the connector 54 is in alignment with the hole 46 in the end 40 of the lower tong arm portion 22. As shown, this provides the proper orientation for the jaws 26 and 28 for the size of the I-beam shown in FIG. 3.

The flange 72' on the I-beam shown in FIG. 4 is substantially wider than the flange 72 shown in FIG. 3. Thus, the lower end portions 22 and 24 of the tong arms must be spread further apart to accommodate the flange. If the jaws were retained in the position shown in FIG. 3, the lower jaw member 50 would be slanted downwardly and would therefore not effectively grip the flange. To correct this problem, pin 64 is removed and the coupling member 54 is pivoted downwardly about pivot pin 60 and in a plane which is substantially the same as the plane of pivotal movement of the tong arms 12 and 14 until the hole 58 coincides with the hole 44 in the end portion 40. The pin 64 is then reinserted so that the jaws are in the position shown in FIG. 4.

The exact opposite problem occurs when trying to engage the smaller flange 72" shown in FIG. 5. In order to accommodate the narrower flange 72", the jaws 26 and 28 are pivoted downwardly so that the hole 58 in the coupling member 54 is in alignment with the upper hole 48 in the end portion 40. The jaw is retained in place by pin 64 in the same manner as described with reference to FIGS. 3 and 4.

The present invention also makes it possible to utilize different jaws on the lower tong arm portions 22 and 24. One such jaw is shown in FIG. 6. This jaw is comprised substantially of a rectangularly shaped plate 74 having a concave working surface. Secured to the back of the plate 74 is a coupling member 76 which is substantially identical to the coupling member 54 and which functions and cooperates with the end 40 of the lower tong arm portions in the same manner as the coupling member 54.

The jaw shown in FIG. 6 is useful for lifting cylindrical members such as pipes or the like. It can also be used for lifting logs or timber. For this latter purpose, spikes 78 may be utilized. Each spike 78 includes a pointed forward portion 80 and a threaded rearward portion 82. An enlarged shoulder 84 is formed intermediate thereof. The spike 78 is secured to the pad 74 by passing the threaded portion 82 through one of the holes 86 formed in the pad and then securing the same thereto by the use of a nut 88. It should be readily apparent that any number of such spikes may be utilized.

The present invention may be embodied in other specific forms without departing from the spirit or essential attributes thereof and accordingly, reference should be made to the appended claims rather than to the foregoing specification as indicating the scope of the invention.

I claim:

1. Lifting tongs for a crane comprising:

a pair of tong arms, said tong arms being pivoted together about a first axis intermediate the ends thereof thereby forming an upper tong arm portion and a lower tong arm portion on each tong arm;

means for moving said lower tong arm portions toward and away from each other;

a jaw adapted to be mounted to the end of each of said lower tong arm portions; and each of said jaws being pivotally movable about an axis parallel to said first axis into a plurality of different positions and including means for locking each jaw in its desired position.

2. Lifting tongs as claimed in claim 1 wherein said means for moving said lower tong arm portions toward and away from each other includes a hydraulic cylinder means.

3. Lifting tongs as claimed in claim 2 further including a tension spring biasing said lower tong arm portions into a closed position.

4. Lifting tongs as claimed in claim 1 wherein said jaws are substantially V-shaped.

5. Lifting tongs as claimed in claim 1 wherein said jaws are arcuately shaped.

6. Lifting tongs as claimed in claim 5 further including a plurality of projections within said jaws for gripping a workpiece to be lifted.

* * * * *